US011396712B2

(12) United States Patent
Lee et al.

(10) Patent No.: US 11,396,712 B2
(45) Date of Patent: Jul. 26, 2022

(54) MANUFACTURING METHOD OF SURFACE-TREATED ZINC-NICKEL ALLOY ELECTROPLATED STEEL SHEET HAVING EXCELLENT CORROSION RESISTIVITY AND PAINTABILITY

(71) Applicant: POSCO, Pohang-si (KR)

(72) Inventors: Kang-Min Lee, Gwangyang-Si (KR); Hye-Jin Yoo, Gwangyang-Si (KR); Je-Hoon Baek, Gwangyang-Si (KR); Chang-Se Byeon, Gwangyang-Si (KR); Jung-Su Kim, Gwangyang-Si (KR)

(73) Assignee: POSCO, Gyeongsangbuk-Do (KR)

( * ) Notice: Subject to any disclaimer, the term of this patent is extended or adjusted under 35 U.S.C. 154(b) by 0 days.

(21) Appl. No.: 17/257,927

(22) PCT Filed: Jun. 28, 2019

(86) PCT No.: PCT/KR2019/007890
§ 371 (c)(1),
(2) Date: Jan. 5, 2021

(87) PCT Pub. No.: WO2020/009379
PCT Pub. Date: Jan. 9, 2020

(65) Prior Publication Data

US 2021/0285118 A1 Sep. 16, 2021

(30) Foreign Application Priority Data

Jul. 6, 2018 (KR) ..... 10-2018-0078528

(51) Int. Cl.
*C25D 5/48* (2006.01)
*C25D 3/56* (2006.01)
(Continued)

(52) U.S. Cl.
CPC ..... *C25D 3/565* (2013.01); *C22C 18/00* (2013.01); *C25D 5/36* (2013.01); *C25F 3/06* (2013.01)

(58) Field of Classification Search
CPC ..... C25D 5/48
(Continued)

(56) References Cited

U.S. PATENT DOCUMENTS

2004/0166360 A1* 8/2004 Imai ..... C23C 28/325 428/658
2006/0169667 A1 8/2006 Koyata et al.
(Continued)

FOREIGN PATENT DOCUMENTS

EP 1439240 7/2004
JP 5129642 1/2013
(Continued)

OTHER PUBLICATIONS

International Search Report—PCT/KR2019/007890 dated Oct. 4, 2019.
(Continued)

*Primary Examiner* — Edna Wong
(74) *Attorney, Agent, or Firm* — Cantor Colburn LLP

(57) ABSTRACT

Provided is a manufacturing method of a surface-treated Zn—Ni alloy electroplated steel sheet, the method comprising the steps of: preparing a Zn—Ni alloy electroplated steel sheet including a steel sheet and a Zn—Ni alloy-plated layer with an Ni content of 5-20 wt % (S1); preparing an alkaline electrolyte solution in which 4-250 g/L of potassium hydroxide (KOH) or sodium hydroxide (NaOH) or both combined are added in distilled water (S2); and inside the alkaline electrolyte solution, placing the Zn—Ni alloy electroplated steel sheet as an anode and installing another metal sheet as a cathode, and applying 2-10 V of an alternating or direct current to conductor electrochemical etching such that a 3-point average value of the arithmetic average roughness (Ra) of the surface of the Zn—Ni alloy electroplated steel sheet reaches 200-400 nm, thereby producing a surface-treated electroplated steel sheet (S3).

5 Claims, 5 Drawing Sheets

(51) Int. Cl.
*C22C 18/00* (2006.01)
*C25D 5/36* (2006.01)
*C25F 3/06* (2006.01)

(58) Field of Classification Search
USPC ..... 205/223
See application file for complete search history.

(56) References Cited

U.S. PATENT DOCUMENTS

| | | | | |
|---|---|---|---|---|
| 2009/0301871 | A1* | 12/2009 | Zappi | C25B 9/73 204/283 |
| 2013/0011734 | A1 | 1/2013 | Arai et al. | |
| 2018/0187313 | A1 | 7/2018 | Shoji et al. | |

FOREIGN PATENT DOCUMENTS

| | | |
|---|---|---|
| KR | 20060090309 | 8/2006 |
| KR | 20120098818 | 9/2012 |
| KR | 20120121025 | 11/2012 |
| KR | 20140141704 | 12/2014 |
| KR | 101615456 | 4/2016 |
| KR | 20170046822 | 5/2017 |
| KR | 20180030185 | 3/2018 |
| WO | 2014084371 | 6/2014 |
| WO | 2017060701 | 4/2017 |

OTHER PUBLICATIONS

European Search Report—European Application No. 19830914.8 dated Jul. 22, 2021, citing KR 10-1615456 and WO 2014/084371.

* cited by examiner

MANUFACTURING METHOD OF SURFACE-TREATED ZINC-NICKEL ALLOY ELECTROPLATED STEEL SHEET HAVING EXCELLENT CORROSION RESISTIVITY AND PAINTABILITY

TECHNICAL FIELD

The present disclosure relates to a method of manufacturing a surface-treated zinc-nickel alloy-electroplated steel sheet.

BACKGROUND ART

A cold-rolled material, plated with a Pb—Sn alloy (Terne metal) containing tin and lead, was mainly used for automobile fuel tank steel sheets until the 1980s, when corrosion resistivity and formability were considered important. This is because Pb—Sn plated layers not only form a protective film on their own to have excellent corrosion resistivity for protecting a Fe base iron but also have excellent ductility and lubricating properties, which facilitate deep drawing processing.

From the 1990s, however, an issue of reducing environmentally hazardous substances was raised nationwide, and efforts to research and develop lead (Pb)-free plating have been continuously made. In this regard, various alloy systems such as Al—Si, Sn—Zn, Zn—Ni, and the like, have newly emerged as plated steel sheets for fuel tanks.

In particular, Zn—Ni alloy-electroplated steel sheets contain about 11 wt % of Ni in a plating layer, resulting in a solid plating layer and a higher melting point as compared to a pure Zn-plated steel sheet. Besides, weldability with a low current may be feasible compared to pure Zn, and corrosion resistivity is excellent.

Meanwhile, in the prior art, a post-treatment based on trivalent chromium ($Cr^{3+}$) or hexavalent chromium ($Cr^{6+}$), which is treated as a type of a hazardous substance, is applied to secure more improved corrosion resistivity and fuel resistance of the Zn—Ni alloy electroplated steel sheet.

In the present disclosure, a method of manufacturing a surface-treated Zn—Ni alloy-electroplated steel sheet employing an eco-friendly alkaline electrolytic solution excluding any harmful substances and having improved corrosion resistivity and paintability by electrolytic etching a Zn—Ni alloy-electroplated steel sheet in a specific range of electrical parameters to form a certain roughness has been suggested.

DISCLOSURE

Technical Problem

The present disclosure is to provide a method of manufacturing a surface-treated Zn—Ni alloy-electroplated steel sheet with excellent corrosion resistivity and paintability, treated in an eco-friendly alkaline electrolytic solution free of harmful substances such as lead and chromium.

Technical Solution

According to an aspect of the present disclosure, a manufacturing method of a surface-treated Zn—Ni alloy electroplated steel sheet includes preparing a Zn—Ni alloy electroplated steel sheet comprising a steel sheet and a Zn—Ni alloy-plated layer formed on the steel sheet, in which a content of Ni in the Zn—Ni alloy-plated layer is 5 wt % to 20 wt % (S1); preparing an alkaline electrolytic solution in which 4 g/L to 250 g/L of potassium hydroxide (KOH), sodium hydroxide (NaOH), or both thereof is added to distilled water (S2); inside the alkaline electrolytic solution, obtaining a surface-treated electroplated steel sheet by placing the Zn—Ni alloy electroplated steel sheet as an anode and installing another metal sheet as a cathode, and applying 2 V to 10 V of an alternating or direct current to conduct electrolytic etching such that a 3-point average value of an arithmetic average roughness (Ra) of a surface of the Zn—Ni alloy electroplated steel sheet reaches 200 nm to 400 nm (S3).

In S2 of preparing the alkaline electrolytic solution, 60 g/L to 250 g/L of KOH or NaOH may be added.

Further, the 3-point average value of the arithmetic average roughness (Ra) may be 200 nm to 250 nm.

After S3 of obtaining the surface-treated electroplated steel sheet, a 3-point average value of a root-mean-square roughness (Rq) of the surface of the surface-treated Zn—Ni alloy-electroplated steel sheet may be 290 nm to 600 nm.

In addition, a 3-point average value of a maximum roughness (Rmax) of the surface of the surface-treated Zn—Ni alloy-electroplated steel sheet after S3 of obtaining the surface-treated electroplated steel sheet may be 2900 nm to 5000 nm.

Advantageous Effects

According to the present disclosure, a surface-treated Zn—Ni alloy electroplated steel sheet having excellent corrosion resistivity and paintability can be manufactured by applying electricity in an eco-friendly alkaline electrolytic solution free of any hazardous substances such as lead and chromium. In this case, a surface roughness can be controlled through changes in a current density, an application time, and the electrolytic solution, thereby increasing utilization as a steel sheet for automobile fuel tanks.

Various advantages and beneficial effects of the present disclosure are not limited to the foregoing, it will be readily understood in the course of describing the specific embodiments of the present disclosure.

BEST MODE FOR INVENTION

Hereinafter, a manufacturing method of a surface-treated Zn—Ni alloy electroplated steel sheet of the present disclosure will be described in detail.

Figure 1:
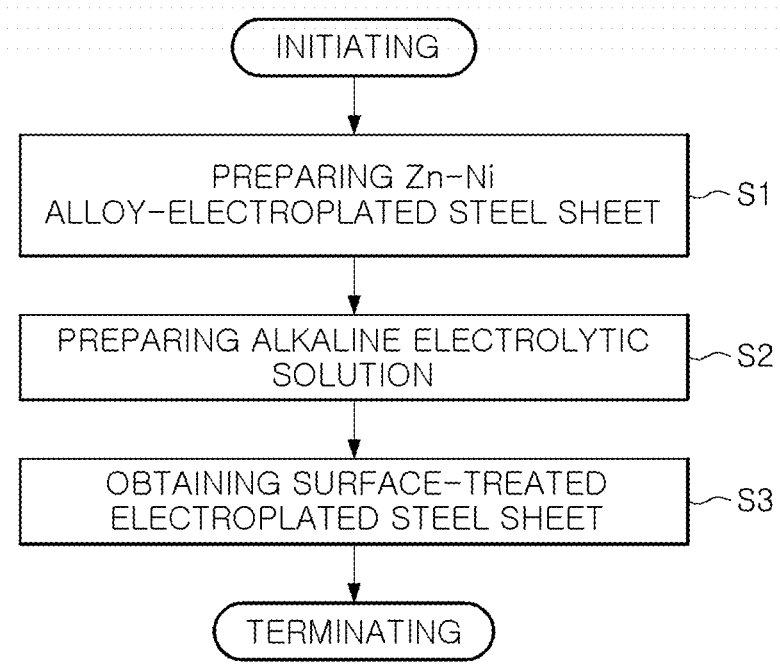
FIG. 1 is a schematic flowchart of a method of manufacturing a surface-treated Zn—Ni alloy electroplated steel sheet of the present disclosure.
Figure 2:
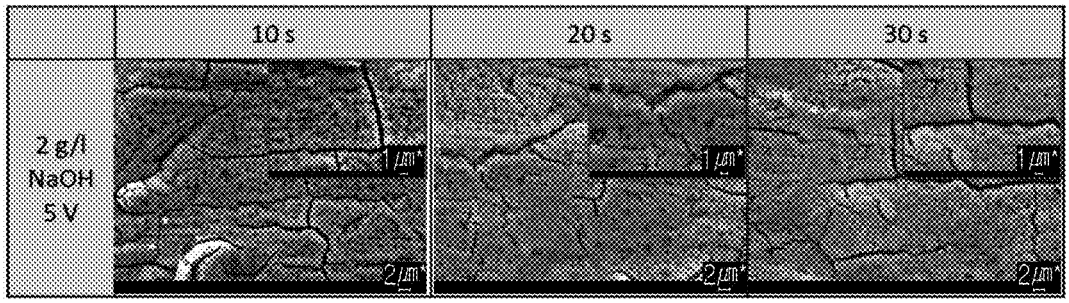
FIG. 2 is a photographic image of a surface-treated Zn—Ni alloy electroplated steel sheet of Comparative Example 1 of the present disclosure obtained using a scanning electron microscope (SEM).
Figure 3:
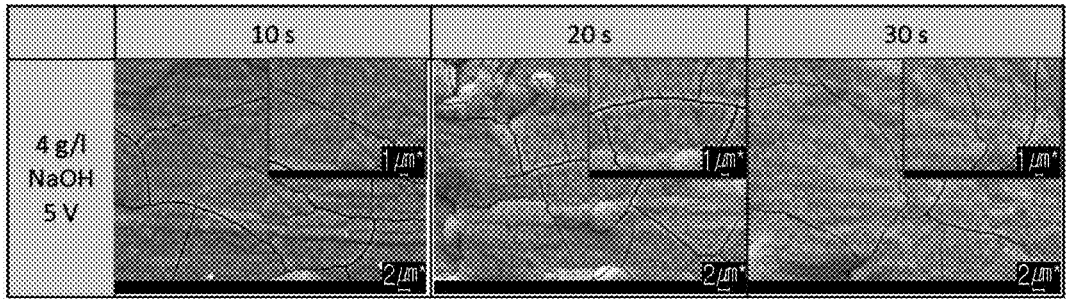
FIG. 3 is a photographic image of a surface-treated Zn—Ni alloy electroplated steel sheet of Inventive Example 1 of the present disclosure obtained using a SEM.
Figure 4:
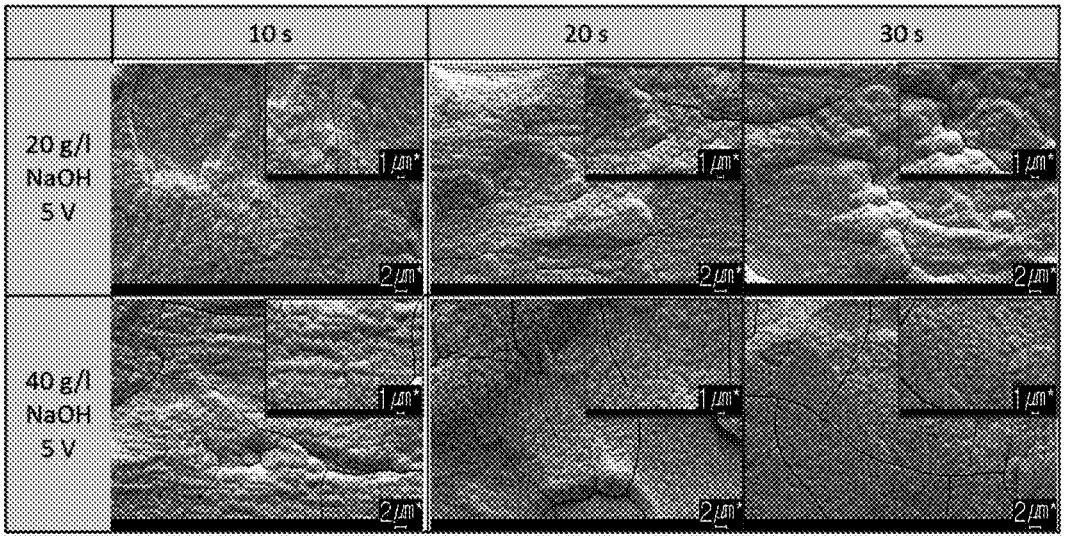
FIG. 4 is photographic images of surface-treated Zn—Ni alloy electroplated steel sheets of Inventive Examples 2 and 3 of the present disclosure obtained using a SEM.
Figure 5:
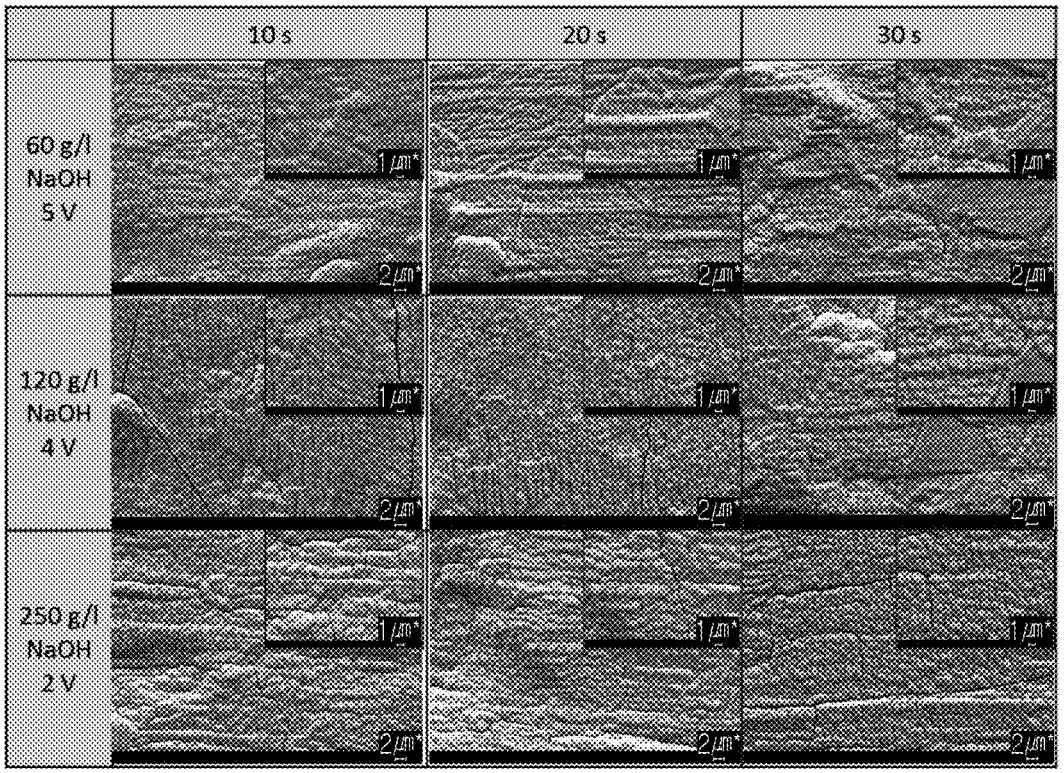
FIG. 5 is photographic images of surface-treated Zn—Ni alloy electroplated steel sheets of Inventive Examples 4 to 6 of the present disclosure obtained using a SEM.
Figure 6:
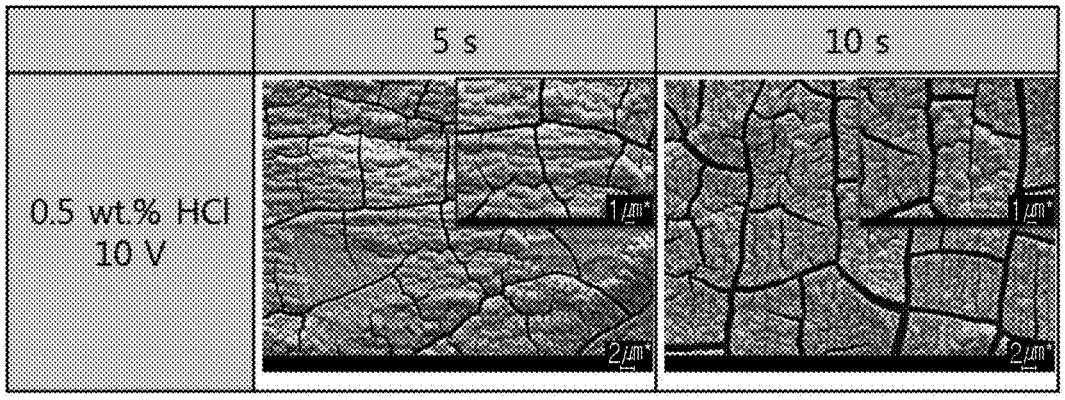
FIG. 6 is a photographic image of a surface-treated Zn—Ni alloy electroplated steel sheet of Comparative Example 2 of the present disclosure obtained using a SEM.

FIG. 1 is a schematic flowchart of a method of manufacturing a surface-treated Zn—Ni alloy electroplated steel sheet of the present disclosure. The manufacturing method according to an aspect of the present disclosure includes preparing a Zn—Ni alloy electroplated steel sheet comprising a steel sheet and a Zn—Ni alloy-plated layer formed on the steel sheet, in which a content of Ni in the Zn—Ni alloy-plated layer is 5 wt % to 20 wt % (S1); preparing an alkaline electrolytic solution in which 4 g/L to 250 g/L of potassium hydroxide (KOH), sodium hydroxide (NaOH), or both thereof is added to distilled water (S2); inside the alkaline electrolytic solution, obtaining a surface-treated electroplated steel sheet by placing the Zn—Ni alloy electroplated steel sheet as an anode and installing another metal sheet as a cathode, and applying 2 V to 10 V of an alternating or direct current to conduct electrolytic etching such that a 3-point average value of an arithmetic average roughness (Ra) of a surface of the Zn—Ni alloy electroplated steel sheet reaches 200 nm to 400 nm (S3).

Preparing a Zn—Ni Alloy-Electroplated Steel Sheet (S1)

First, a Zn—Ni alloy-electroplated steel sheet to be subjected to surface treatment is prepared. The Zn—Ni alloy-electroplated steel sheet may include a steel sheet and a Zn—Ni alloy-plated layer formed on the steel sheet.

The steel sheet, as a metal base of the Zn—Ni alloy-electroplated steel sheet, may be a steel sheet containing Fe and an alloy containing Fe as a base material, but is hardly affected by an alkaline electrolytic solution during electrolytic etching due to the presence of the Zn—Ni alloy-plated layer formed thereon. Accordingly, the steel sheet is not particularly limited in the present disclosure.

A Ni content in the Zn—Ni alloy-plated layer is in the range of 5 wt % to 20 wt %. When the Ni content is less than 5 wt %, corrosion resistivity deteriorates due to relatively high electrochemical reactivity of Zn. In contrast, when the Ni content exceeds 20 wt %, the effect of improving corrosion resistivity in accordance with the addition of Ni becomes insignificant, manufacturing costs increase, and workability deteriorates due to a rapid increase in hardness. Accordingly, the Ni content of the Zn—Ni alloy-plated layer is preferably 5 wt % to 20%.

Preparing an Alkaline Electrolytic Solution (S2)

In S2 of preparing an alkaline electrolyte, an alkaline electrolyte in which 4 g/L to 250 g/L of potassium hydroxide (KOH) or sodium hydroxide (NaOH) is independently added to distilled water, or both at the same time, is prepared.

In the case of forming a Zn—Ni alloy layer by electroplating, it is known that minute cracks (microcracks) on a surface expand an anodic reaction to suppress local corrosion. When electrolytic etching is performed with an acidic electrolytic solution such as hydrochloric acid (HCl) electrolytic solution, however, a width of the microcrack significantly increases, making it difficult to suppress local corrosion. In contrast, in the case of electrolytic etching with an electrolytic solution to which a specific concentration of KOH or NaOH is added, not only the microcrack is prevented from widening but paintability is improved by forming not only a number of irregularities but also micropores of submicron size in the surface.

When KOH or NaOH has a concentration of less than 4 g/L, electrical conductivity of the solution is less than 10 mΩ/cm, and a surface treatment is difficult to perform at high speed, thus resulting in decreased productivity. Accordingly, a lower limit of the amount of the added KOH or NaOH was set to be 4 g/L. Meanwhile, when the concentration of KOH or NaOH exceeds 250 g/L, the electrical conductivity of the solution begins to fall again from the point of 250 g/L, and thus, an upper limit of the added amount of KOH or NaOH was set to be 250 g/L. In this regard, the amount of added KOH or NaOH may be 4 g/L to 250 g/L, and may be 60 g/L to 250 g/L in terms of further improved corrosion resistivity.

In addition, in addition to KOH or NaOH, sodium silicate, various metal salts (manganese salt, vanadium salt, etc.) and metal oxides such as TiO2 and ZrO2 may be additionally added to the alkaline electrolytic solution.

Obtaining Surface-Treated Electroplated Steel Sheet (S3)

In S3 of obtaining the surface-treated electroplated steel sheet, inside the alkaline electrolytic solution, the Zn—Ni alloy-electroplated steel sheet is placed on an anode, and another metal plate is placed on a cathode, followed by applying AC or DC power of 2V to 10V to conduct electrolytic etching. The other metal plate may be, for example, stainless steel, titanium plated with platinum, or titanium plated with carbon or iridium oxide ($IrO_2$), or the like. At this time, in the alkaline electrolytic solution, hydrogen gas is generated by decomposition of water on a surface of the metal plate, the cathode, and oxygen gas is generated on a surface of the Zn—Ni alloy-electroplated steel plate, an anode. At the same time, an oxide film or a hydroxide film is formed on the Zn—Ni alloy-electroplated steel plate. By forming the oxide film or the hydroxide film as described above, the surface-treated Zn—Ni alloy-electroplated steel sheet has primary corrosion resistivity, so that corrosion resistivity can be improved.

The present inventors have found that when electrolytically etched with an alkaline electrolyte, the Zn—Ni alloy-electroplated steel sheet has a surface roughness greatly affecting the corrosion resistivity and paintability of the Zn—Ni alloy-electroplated steel sheet. As a result of their continuous research and efforts, it has been shown that a roughness tends to increase as a treatment time decreases in a same solution or microcracking occurs on surfaces, and that an electroplated steel sheet excellent in both corrosion resistivity and paintability could be obtained when a 3-point average of an arithmetic average roughness (Ra) of the surface of the surface-treated Zn—Ni alloy-electroplated steel sheet is 200 nm to 400 nm.

According to the above research result, the 3-point average value of the arithmetic mean roughness (Ra) of the surface of the surface-treated Zn—Ni alloy-electroplated steel sheet is adjusted to be between 200 nm and 400 nm during the electrolytic etching in the present disclosure. The arithmetic mean roughness (Ra) can be easily controlled by adjusting an applied voltage and an application time. The arithmetic mean roughness (Ra) is an arithmetic mean value of an absolute value of a length from a center line of a specimen to a cross-sectional curve of a surface of the specimen within a reference length. In the present disclosure, the arithmetic mean roughness (Ra) is used as an indicator for irregularities formed on the surface of the surface-treated Zn—Ni alloy-electroplated steel sheet.

When the 3-point average value of the arithmetic mean roughness (Ra) is less than 200 nm, painting adhesion cannot be stably secured. Meanwhile, the paintability is deteriorated even when the arithmetic average roughness (Ra) exceeds 400 nm. As such, it is preferable that the 3-point average value of the arithmetic mean roughness (Ra) be 200 nm to 400 nm, more preferably 200 nm to 250 nm, which leads to particularly excellent corrosion resistivity.

Meanwhile, a surface roughness of the Zn—Ni alloy-electroplated steel sheet, unlike the arithmetic mean roughness (Ra), can be calculated as a root-mean-square (rms) and expressed as a value of the root-mean-square roughness (Rq). When peaks of the irregularities become flat when ground, a value of the root mean square roughness (Rq) may increase by about 50% compared to the arithmetic mean roughness (Ra), and in the present disclosure, compared to the arithmetic mean roughness (Ra). The value of the root-mean-square roughness (Rq) improved by about 20 to 50% compared to the arithmetic mean roughness (Ra) was derived according to a shape of etching. It is preferable that the 3-point average value of the calculated root-mean-square roughness (Rq) be 290 nm to 600 nm. When the 3-point average value of the root-mean-square roughness (Rq) is less than 290 nm, painting adhesion cannot be stably secured. On the other hand, when the 3-point average value of the root-mean-square roughness (Rq) exceeds 600 nm, paintability deteriorates. In this regard, the 3-point average value of the root-mean-square roughness (Rq) is 290 nm to 600 nm, more preferably 290 nm to 330 nm for more excellent corrosion resistivity.

In addition, a 3-point average value of a maximum roughness (Rmax) of the surface of the Zn—Ni alloy-electroplated steel sheet can be controlled to be 2900 nm to 5000 nm during the electrolytic etching. In this case, the maximum roughness (Rmax) may be defined as a distance, measured over one reference length, between two parallel lines in contact with a highest peak and a deepest valley of the irregularities while being parallel to a center line of a roughness curve.

Conventionally, in a manufacturing process of an electroplated steel sheet, a step of providing appropriate roughness by applying a reduction of about 1% to remove a defect, such as a stretcher strain, on a surface is inevitably involved. For make the maximum roughness (Rmax) of the steel sheet less than 2900 nm by the electroplated steel sheet manufacturing method of the present disclosure, etching is required to be performed for a long time such as 30 seconds or more. Since electrolytic etching for more than 30 seconds in an actual continuous process operation is a waste in terms of economy and process, however, a lower limit of the 3-point average value of the maximum roughness (Rmax) was set to be 2900 nm in the present disclosure. Meanwhile, the paintability deteriorates when the 3-point average value of the maximum roughness (Rmax) exceeds 5000 nm. Therefore, it is preferable that the 3-point average value of the maximum roughness (Rmax) be 2900 nm to 5000 nm, more preferably 2900 nm to 3400 nm.

MODE FOR INVENTION

Hereinafter, examples of the present disclosure will be described in detail. The following examples are only for understanding the present disclosure and are not intended to limit a scope of the present disclosure. This is because the scope of the present disclosure may be determined by contents described in the claims and contents reasonably inferred therefrom.

Example Embodiment 1

In Example Embodiment 1, a Zn—Ni alloy-electroplated steel sheet having a Ni content of 11 wt % was cut into a thin plate having a width of 50 mm, a length of 75 mm and a thickness of 0.6 mm, washed with distilled water and dried. Electrolytic etching was then performed according to conditions shown in Table 1 below.

A microstructure of the Zn—Ni alloy-electroplated steel sheet surface-treated by electrolytic etching was observed with a scanning electron microscope (SEM), and a surface roughness, corrosion resistivity and paintability were evaluated according to the following evaluation methods. Results are shown in Table 2.

1. Surface Roughness Evaluation

A surface roughness of the surface-treated Zn—Ni alloy electroplated steel sheet specimen according to the electrolyte conditions was analyzed with a scanning probe microscope, and the arithmetic mean roughness (Ra), the root mean square roughness (Rq) the and maximum roughness (Rmax) were measured at 3 points of a surface of the specimen while setting the application time to 20 s (10 s in the case of Comparative Example 2), and average values thereof are shown in Table 2. The arithmetic mean roughness (Ra), the root mean square roughness (Rq) and the maximum roughness (Rmax) were measured using a KOSAKA SE700 device, and cut-offs (λc, a filter filtering out small waveform vibrations generated from the surface) were set to 2.5 mm.

For reference, definitions of the arithmetic mean roughness (Ra), the root mean square roughness (Rq) and the maximum roughness (Rmax) in Table 2 are as follows:

Ra (arithmetic mean roughness): an arithmetic mean value of an absolute value of a length from a center line of a specimen to a curve of a surface of the specimen within one reference length;

Rq (root mean square roughness): a root mean square value of an absolute value of a length from a center line of a specimen to a curve of a surface of the specimen within one reference length; and Rmax (maximum roughness): a distance, measured over one reference length from a roughness curve, between two parallel lines in contact with a highest peak and a deepest valley of an irregularity while being parallel to a center line of the roughness curve.

2. Corrosion Resistivity Evaluation

In order to examine corrosion behavior of the electrolytically etched Zn—Ni alloy-electroplated steel sheet specimen, an immersion corrosion test (ASTM G31) was performed in a 5 wt % NaCl solution at 25° C.

A degree of corrosion was compared with that of a Zn—Ni alloy-electroplated steel sheet, which is not electrolytically etched, by weight loss based on an immersion time of 5 days. "X", "○" and "◎" were indicated for the cases of being inferior, being equivalent or superior by within 5%, and superior by 5% or more 5, respectively, and results thereof are shown in Table 2 below.

3. Paintability Evaluation

Each prepared specimen was subjected to color painting on a surface thereof, and the paintability was then evaluated. The evaluation was carried out with the naked eye. The case, in which cracking or lifting of the surface was observed with the naked eye visually after painting, was expressed as "NG", and the case in which nothing was observed, was expressed as "GO", and results thereof are shown in Table 2 below.

TABLE 1

| TYPE | ELECTROLYTIC SOLUTION | APPLIED VOLTAGE (V) | APPLICATION TIME (s) |
|---|---|---|---|
| COMPARATIVE EXAMPLE 1 | 2 g/L NaOH SOLUTION | 5 | 10, 20, 30 |
| INVENTIVE EXAMPLE 1 | 4 g/L NaOH SOLUTION | 5 | 10, 20, 30 |
| INVENTIVE EXAMPLE 2 | 20 g/L NaOH SOLUTION | 5 | 10, 20, 30 |
| INVENTIVE EXAMPLE 3 | 40 g/L NaOH SOLUTION | 5 | 10, 20, 30 |
| INVENTIVE EXAMPLE 4 | 60 g/L NaOH SOLUTION | 5 | 10, 20, 30 |
| INVENTIVE EXAMPLE 5 | 120 g/L NaOH SOLUTION | 4 | 10, 20, 30 |
| INVENTIVE EXAMPLE 6 | 250 g/L NaOH SOLUTION | 2 | 10, 20, 30 |
| COMPARATIVE EXAMPLE 2 | 0.5 WT % HCI SOLUTION | 10 | 5, 10 |

TABLE 2

| TYPE | SURFACE ROUGHNESS (3-POINT AVG) | | | CORROSION | |
|---|---|---|---|---|---|
| | Ra (nm) | Rq (nm) | Rmax (nm) | RESISTIVITY | PAINTABILITY |
| COMPARATIVE EXAMPLE 1 | 438 | 047 | 5381 | O | NG |
| INVENTIVE EXAMPLE 1 | 361 | 473 | 4486 | O | GO |
| INVENTIVE EXAMPLE 2 | 283 | 372 | 3801 | O | GO |
| INVENTIVE EXAMPLE 3 | 258 | 347 | 3591 | O | GO |
| INVENTIVE EXAMPLE 4 | 221 | 329 | 3308 | ◎ | GO |
| INVENTIVE EXAMPLE 5 | 219 | 3.20 | 3213 | ◎ | GO |
| INVENTIVE EXAMPLE 6 | 200 | 290 | 2954 | ◎ | GO |
| COMPARATIVE EXAMPLE 2 | 490 | 535 | 4619 | X | NG |

It was confirmed that Inventive Examples 1 to 6, in which 4 g/L to 250 g/L NaOH solution was used as an electrolytic solution and an applied voltage was in the range of 2 V to 10 V according to the conditions of the present disclosure, showed excellent corrosion resistivity and paintability.

In contrast, Comparative Example 1, in which a 2 g/L NaOH solution was used as the electrolytic solution, was shown to have excellent corrosion resistance, but poor paintability due to an inferior arithmetic average roughness exceeding 400 nm.

In the case of Comparative Example 2, in which an acidic electrolytic solution of 0.5 wt % HCl was used as the electrolyte instead of an alkaline electrolytic solution, a microstructure of the etched Zn—Ni alloy-electroplated steel sheet was using a SEM, and as a result, not only was a separate oxide film for corrosion resistivity and not formed, but a width of microcracks was also gradually increased over time, resulting in significantly deteriorated corrosion resistivity. In addition, due to excessive etching, the surface roughness was excessively increased, thereby failing to satisfy the corrosion resistivity and paintability conditions of the present disclosure.

Reference Example Embodiment 1

In Reference Example Embodiment 1, the Zn—Ni alloy-electroplated steel sheet surface-treated with the alkaline electrolytic solution in Example 1 was electrolytically etched again with an acidic electrolytic solution according to the conditions in Table 3 below.

A microstructure of the electrolytically etched Zn—Ni alloy-electroplated steel sheet was then observed with a SEM, and a surface roughness, corrosion resistivity and paintability were evaluated at 3 points according to the evaluation method of Example 1 in which the specimen having the application time of 10 s was described, and results thereof are shown in Table 4 below.

TABLE 3

| TYPE | STEEL SHEET SPECIMEN | ELECTROLYTIC SOLUTION | APPLIED VOLTAGE (V) | APPLICATION TIME (s) |
|---|---|---|---|---|
| REFERENCE EXAMPLE 1 | INVENTIVE EXAMPLE 4 (60 g/L NaOH SOLUTION) | 0.5 WT % HCI SOLUTION | 10 | 5, 10 |
| REFERENCE EXAMPLE 2 | INVENTIVE EXAMPLE 5 (120 g/L NaOH SOLUTION) | 0.5 WT % HCI SOLUTION | 10 | 5, 10 |
| REFERENCE EXAMPLE 3 | INVENTIVE EXAMPLE 6 (250 g/L NaOH SOLUTION) | 0.5 WT % HCI SOLUTION | 10 | 5, 10 |

TABLE 4

| TYPE | SURFACE ROUGHNESS (3-POINT AVG) Ra (nm) | Rq (nm) | Rmax (nm) | CORROSION RESISTIVITY | PAINTABILITY |
|---|---|---|---|---|---|
| REFERENCE EXAMPLE 1 | 274 | 367 | 3608 | X | NG |
| REFERENCE EXAMPLE 2 | 334 | 518 | 4361 | X | NG |
| REFERENCE EXAMPLE 3 | 427 | 637 | 5271 | X | NG |

As shown in the results of Reference Examples 1 to 3 of Reference Example Embodiment 1 above, the case of electrolytically etching the Zn—Ni alloy-electroplated steel sheet electrolytically etched with an alkaline electrolytic solution again with an acidic electrolytic solution (0.5 wt % HCl solution), was shown to have deteriorated corrosion resistivity and paintability while satisfying the surface roughness condition.

Figure 7:
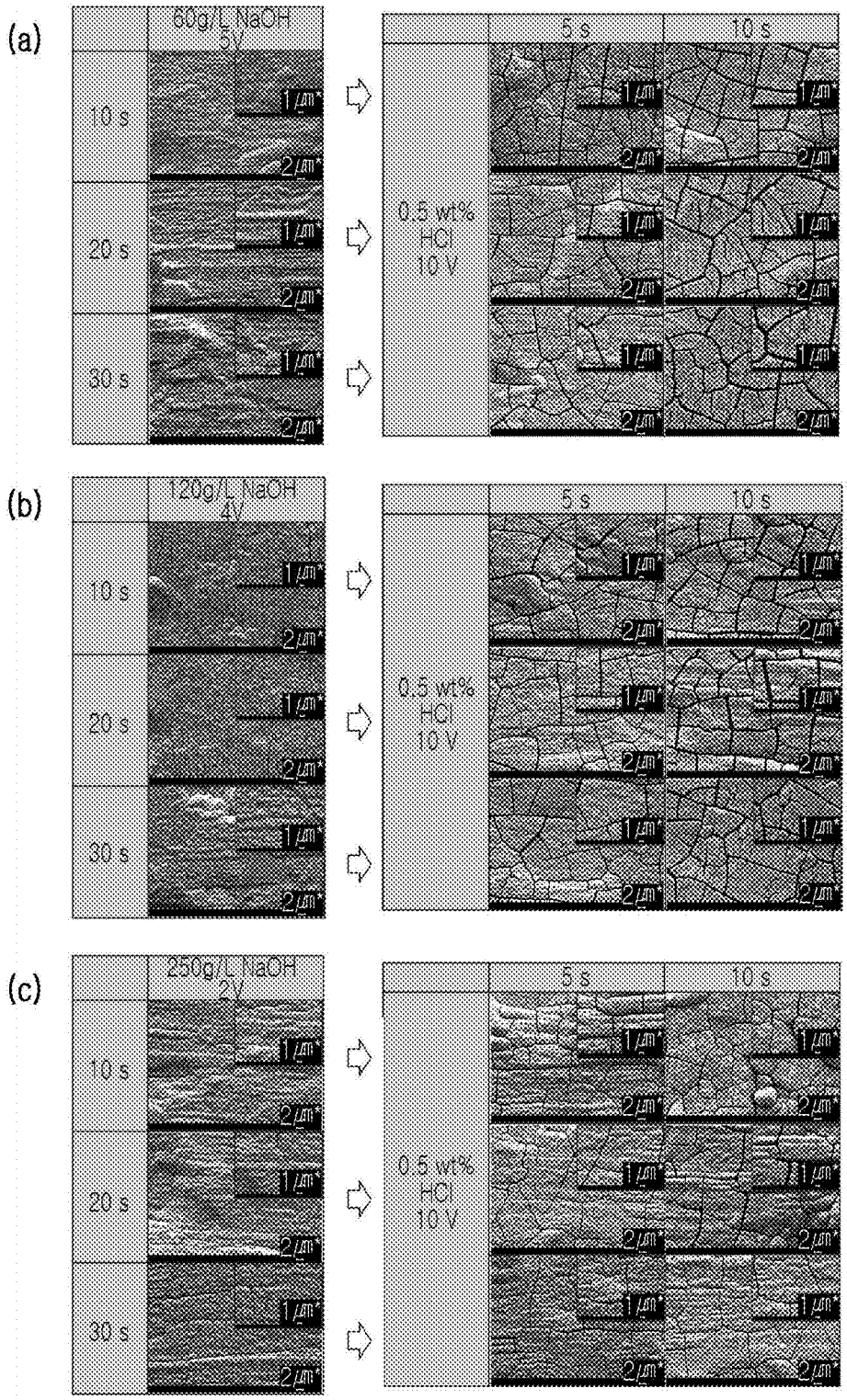
FIG. 7 is photographic images of surface-treated Zn—Ni alloy electroplated steel sheets of Reference Example Embodiment 1 of the present disclosure obtained using a SEM, where (a) to (c) are photographic images of Reference Examples 1 to 3, respectively.

This is considered to be due to etching of multiple irregularities formed using the alkaline electrolytic solution and re-occurrence of microcracks having a 1 μm to 2 μm width, based on FIGS. 7A to 7C in which the surfaces of the steel sheets of the specimens of Reference Examples 1 to 3 were observed with a SEM.

Reference Example Embodiment 2

In Reference Example Embodiment 2, electrolytic etching was performed again in an alkaline electrolytic solution according to the conditions of Table 5 below on the Zn—Ni alloy-electroplated steel sheet surface-treated in Comparative Example 2 with the acidic electrolytic solution (0.5 wt % HCl solution). A microstructure of the electrolytically etched Zn—Ni alloy-electroplated steel sheet was then observed with a SEM, and a surface roughness, corrosion resistivity and paintability were evaluated at 3 points according to the evaluation method of Example Embodiment 1 in which the specimen having the application time of 20 s was described, and results thereof are shown in Table 6 below.

TABLE 5

| TYPE | STEEL SHEET SPECIMEN | ELECTROLYTIC SOLUTION | APPLIED VOLTAGE (V) | APPLICATION TIME (s) |
|---|---|---|---|---|
| REFERENCE EXAMPLE 4 | COMPARATIVE EXAMPLE 2 (0.5 WT % HCI SOLUTION) | 60 g/L NaOH SOLUTION | 4 | 10, 20, 30 |
| REFERENCE EXAMPLE 5 | COMPARATIVE EXAMPLE 2 (0.5 WT % HCI SOLUTION) | 120 g/L NaOH SOLUTION | 4 | 10, 20, 30 |

TABLE 6

| TYPE | SURFACE ROUGHNESS (3-POINT AVG) Ra (nm) | Rq (nm) | Rmax (nm) | CORROSION RESISTIVITY | PAINTABILITY |
|---|---|---|---|---|---|
| REFERENCE EXAMPLE 4 | 379 | 481 | 4219 | X | NG |
| REFERENCE EXAMPLE 5 | 347 | 433 | 3231 | X | NG |

Figure 8:
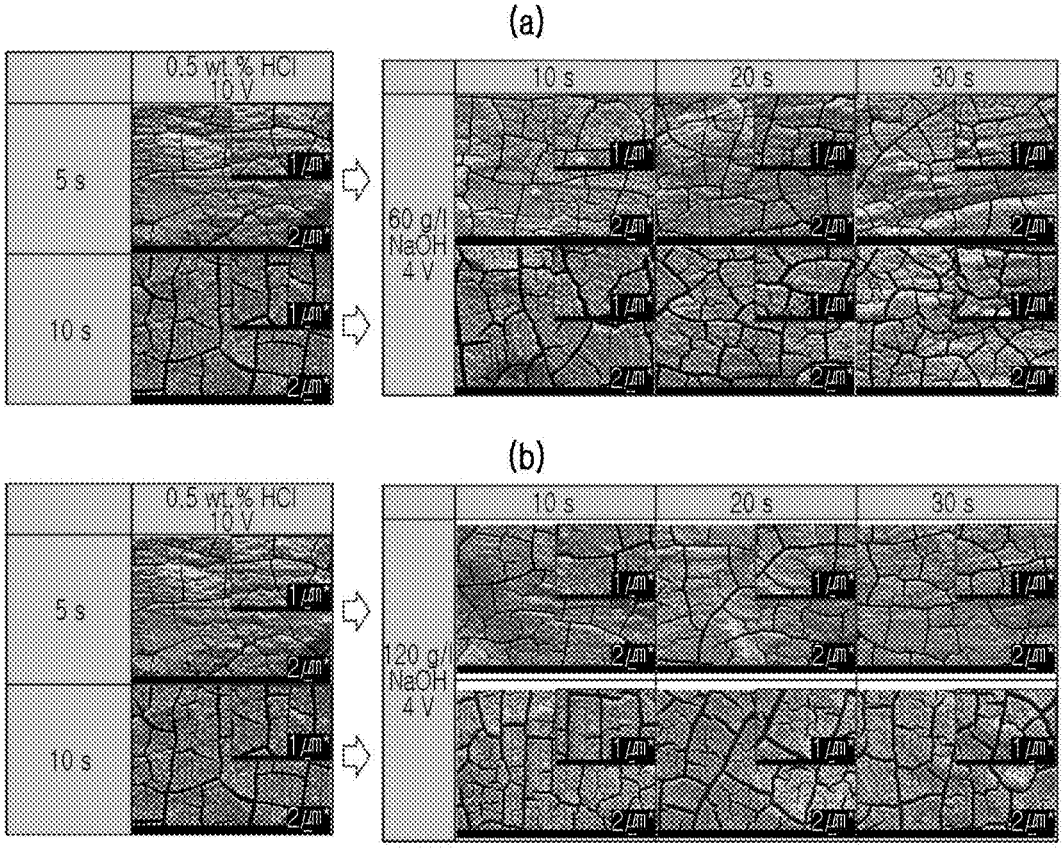
FIG. 8 is photographic images of surface-treated Zn—Ni alloy electroplated steel sheets of Reference Example Embodiment 2 of the present disclosure obtained using a SEM, where (a) and (b) are photographic images of Reference Examples 4 and 5, respectively.

Based on FIGS. 8A and 8B in which the surfaces of the steel plates of the specimens of Reference Examples 4 and 5 of Reference Example Embodiment 2 were observed with a SEM, the widths of the microcracks increased over the etching time, and microcracks having a size of several micrometers were further formed inside the cracks. This resulted in deterioration of corrosion resistivity and paintability, thereby failing to satisfy the conditions of the present disclosure.

Therefore, as shown in the experimental result of Reference Example Embodiment 2 above, corrosion resistivity and paintability were deteriorated even when the Zn—Ni alloy-electroplated steel sheet electrolytically etched with an acidic electrolytic solution was electrolytically etched again with an alkaline electrolytic solution.

While example embodiments have been shown and described above, it will be apparent to those skilled in the art that modifications and variations could be made without departing from the scope of the present disclosure as defined by the appended claims.

The invention claimed is:

1. A manufacturing method of a surface-treated Zn—Ni alloy electroplated steel sheet, comprising:

preparing a Zn—Ni alloy electroplated steel sheet for electrolytic etching, wherein the Zn—Ni alloy electroplated steel sheet is prepared by electroplating a Zn—Ni alloy on a steel sheet to form a Zn—Ni alloy-plated layer on the steel sheet, and a content of Ni in the Zn—Ni alloy-plated layer is 5 wt % to 20 wt %;

preparing an alkaline electrolytic solution in which 4 g/L to 250 g/L of potassium hydroxide (KOH), sodium hydroxide (NaOH), or both thereof is added to distilled water;

inside the alkaline electrolytic solution, obtaining a surface-treated electroplated steel sheet by placing the Zn—Ni alloy electroplated steel sheet as an anode and installing another metal sheet as a cathode, and applying 2 V to 10 V of an alternating or direct current to conduct the electrolytic etching such that a 3-point average value of an arithmetic average roughness (Ra) of a surface of the Zn—Ni alloy electroplated steel sheet reaches 200 nm to 400 nm.

2. The manufacturing method according to claim 1, wherein, in the preparing of the alkaline electrolytic solution, 60 g/L to 250 g/L of the KOH or the NaOH is added to the distilled water.

3. The manufacturing method according to claim 1, wherein the 3-point average value of the arithmetic average roughness (Ra) is 200 nm to 250 nm.

4. The manufacturing method according to claim 1, wherein the surface of the surface-treated electroplated steel sheet has a 3-point average value of a root-mean-square roughness (Rq) in a range of 290 nm to 600 nm.

5. The manufacturing method according to claim 1, wherein the surface of the surface-treated electroplated steel sheet has a 3-point average value of a maximum roughness (Rmax) in a range of 2900 nm to 5000 nm.

* * * * *